US007810639B2

(12) United States Patent
Djulaini et al.

(10) Patent No.: US 7,810,639 B2
(45) Date of Patent: Oct. 12, 2010

(54) CONTAINER FOR CONSUMER ELECTRONICS

(75) Inventors: Nova Djulaini, Singapore (SG); Terence Ten Teck Hong, Singapore (SG)

(73) Assignee: Seagate Technology LLC, Scotts Valley, CA (US)

( * ) Notice: Subject to any disclaimer, the term of this patent is extended or adjusted under 35 U.S.C. 154(b) by 378 days.

(21) Appl. No.: 11/672,160

(22) Filed: Feb. 7, 2007

(65) Prior Publication Data

US 2007/0187268 A1 Aug. 16, 2007

Related U.S. Application Data

(60) Provisional application No. 60/772,337, filed on Feb. 10, 2006.

(51) Int. Cl.
*B65D 85/00* (2006.01)

(52) U.S. Cl. ..... 206/307; 206/523; 220/507; 220/528

(58) Field of Classification Search ..... 206/307, 206/307.1, 387.1, 387.12, 387.13, 387.14, 206/387.15, 523, 546, 725; 220/23.9, 23.89, 220/503, 505, 507, 526, 528, 551, 4.21, 4.22, 220/4.23, 4.24

See application file for complete search history.

(56) References Cited

U.S. PATENT DOCUMENTS

| | | | | |
|---|---|---|---|---|
| 2,783,879 | A | 3/1957 | Emery | |
| 3,128,030 | A | 4/1964 | Davies | |
| 3,164,478 | A | 1/1965 | Bostrom | |
| 3,416,690 | A | 12/1968 | Michael | |
| 3,580,467 | A | 5/1971 | Pieszak et al. | 206/319 |
| 3,583,559 | A | 6/1971 | Brander | |
| 3,756,383 | A * | 9/1973 | Kryter | 206/387.14 |
| 3,835,994 | A | 9/1974 | Davis et al. | |
| 4,173,286 | A * | 11/1979 | Stanko | 220/4.24 |
| 4,241,830 | A | 12/1980 | Di Gesu ' | |
| 4,593,816 | A | 6/1986 | Langenbeck | 206/425 |
| 4,840,276 | A | 6/1989 | George | |
| 4,860,894 | A | 8/1989 | Koenig | |
| 5,253,755 | A | 10/1993 | Maenke | |
| 5,259,508 | A | 11/1993 | Beckerman | 206/587 |
| 5,366,080 | A | 11/1994 | Carstersen et al. | |
| 5,706,951 | A | 1/1998 | Oinuma et al. | |
| 5,755,332 | A | 5/1998 | Holliday et al. | |

(Continued)

*Primary Examiner*—J. Gregory Pickett
(74) *Attorney, Agent, or Firm*—Leanne Taveggia Farrell; Westman, Champlin & Kelly, P.A.

(57) ABSTRACT

A container is provided for use in the shipment and storage of consumer electronics. In particular, the container is useful for the shipment and storage of consumer electronics of different sizes, weights and shapes. The container includes a base having a bottom, at least two end walls and at least two side walls. The base includes base partitions forming a plurality of lower cavities for receiving the consumer electronics. The base partitions are spaced from one another and arranged between the end walls and the side walls. Each lower cavity has a width extending between the side walls. The container also includes a bottom surface including a plurality of cover partitions forming a plurality of upper cavities adapted to align with the lower cavities of the base to form compartments configured to store the consumer electronics. The container also includes an insert positioned between the base and the cover, the insert including a first frame wall and a second frame wall each positioned on one of the at least two side walls of the base that engages the base with its pair of webs.

20 Claims, 7 Drawing Sheets

U.S. PATENT DOCUMENTS 5,775,508 A 7/1998 Bongard et al.
5,806,286 A 9/1998 Oinuma et al.
5,934,463 A * 8/1999 Yu ..... 206/307.1
5,993,745 A 11/1999 Laska ..... 422/104
6,010,007 A 1/2000 Moren et al.
6,116,423 A 9/2000 Troxtell, Jr. et al.
6,142,304 A 11/2000 Moren et al.
6,216,885 B1 4/2001 Guillaume ..... 211/85.13
6,588,595 B2 7/2003 Levin et al.
6,786,334 B2 9/2004 Smith ..... 206/592
6,820,743 B2 11/2004 Hurley et al. ..... 206/427
6,840,381 B2 1/2005 Stephens
6,866,150 B2 3/2005 Mason et al.
7,134,553 B2 11/2006 Stephens
7,237,675 B2 7/2007 O'Malley ..... 206/433
2001/0020595 A1 9/2001 Koike ..... 206/521
2002/0023857 A1 2/2002 Smith ..... 206/588
2006/0076253 A1 4/2006 Hong et al.

* cited by examiner

CONTAINER FOR CONSUMER ELECTRONICS

CROSS REFERENCE TO RELATED APPLICATION

This application claims the benefit of U.S. Provisional Application 60/772,337, filed on Feb. 10, 2006 entitled "BREAK-WAVE ON ACTIVE BEAM SHOCK PROTECTION IN CONTAINER FOR DISK DRIVES," the disclosure of which is incorporated herein by reference in its entirety.

BACKGROUND

Data storage systems are consumer electronic devices commonly used in computing systems such as personal computers, laptop computers and other computing devices. Data storage systems are often shipped from a manufacturer or distributor to another location where the systems can be sold or used. Data storage systems are precision electro-mechanical devices that electronically store data and allow data to be manipulated in accordance with the functioning of the computing devices in which the data storage systems are installed. For instance, an exemplary data storage system, such as a disc drive, includes a base and a cover that houses a variety of internal components. Internal components in a disc drive, for instance, include one or more data storage discs, a spindle motor and a spindle hub. The disc(s) are mounted to the spindle hub and the spindle motor drives the spindle hub which rotates the disc(s). At least one read/write component, known as the "head", reads and writes data to and from a corresponding disc.

During shipment and storage, packages or containers for data storage systems must provide proper support and protection to prevent damage to the systems especially in cases where the container is dropped or contacted by a foreign object. For instance, in the case of a disc drive, even small vibrations and other shock can cause damage to the disc drive that can result in the disc drive becoming unsuitable for sale to a consumer.

SUMMARY

A container is provided for shipment and storage of consumer electronics. The container includes a base having a bottom, at least two end walls and at least two side walls. The base includes base partitions forming a plurality of lower cavities for receiving the consumer electronics. The base partitions are spaced from one another and are arranged between the end walls and the side walls. Each lower cavity has a width extending between the side walls. The container also includes a cover having a bottom surface including a plurality of cover partitions forming a plurality of upper cavities adapted to align with the lower cavities of the base to form compartments. The compartments are configured to store the consumer electronics. The container also includes an insert positioned between the base and the cover. The insert includes a first frame wall and a second frame wall positioned on the side walls of the base and extending into selected compartments. The insert makes the container adaptable for use with consumer electronics of different sizes and weights, while still providing adequate vibration and shock protection to prevent damage to the consumer electronics during shipment and storage. The insert provides additional structural support to the container that provides increased shock protection for heavier consumer electronics.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

At least some embodiments of the concepts described herein are based on the recognition that consumer electronics, are available in different sizes and weights. Example consumer electronics include digital music players, data storage systems, personal data assistants and cell phones. For example, disc drives are common data storage systems that are available in different form factors. Conventional consumer electronics container systems provide storage compartments designed for consumer electronics having a particular shape, weight and size. However, these conventional systems are not suitable for accommodating consumer electronics having alternate sizes and alternative weights. Thus, with these conventional container systems, different containers having varying compartments sizes and weights must be designed and manufactured for each size and weight. In embodiments of the concepts described herein, a container is provided having upper and lower cavities forming compartments. The container is designed to accommodate various sizes and weights of consumer electronics by modifying a size of the selected compartments along with appropriate cushioning features in the container with an insert.

Figure 1:
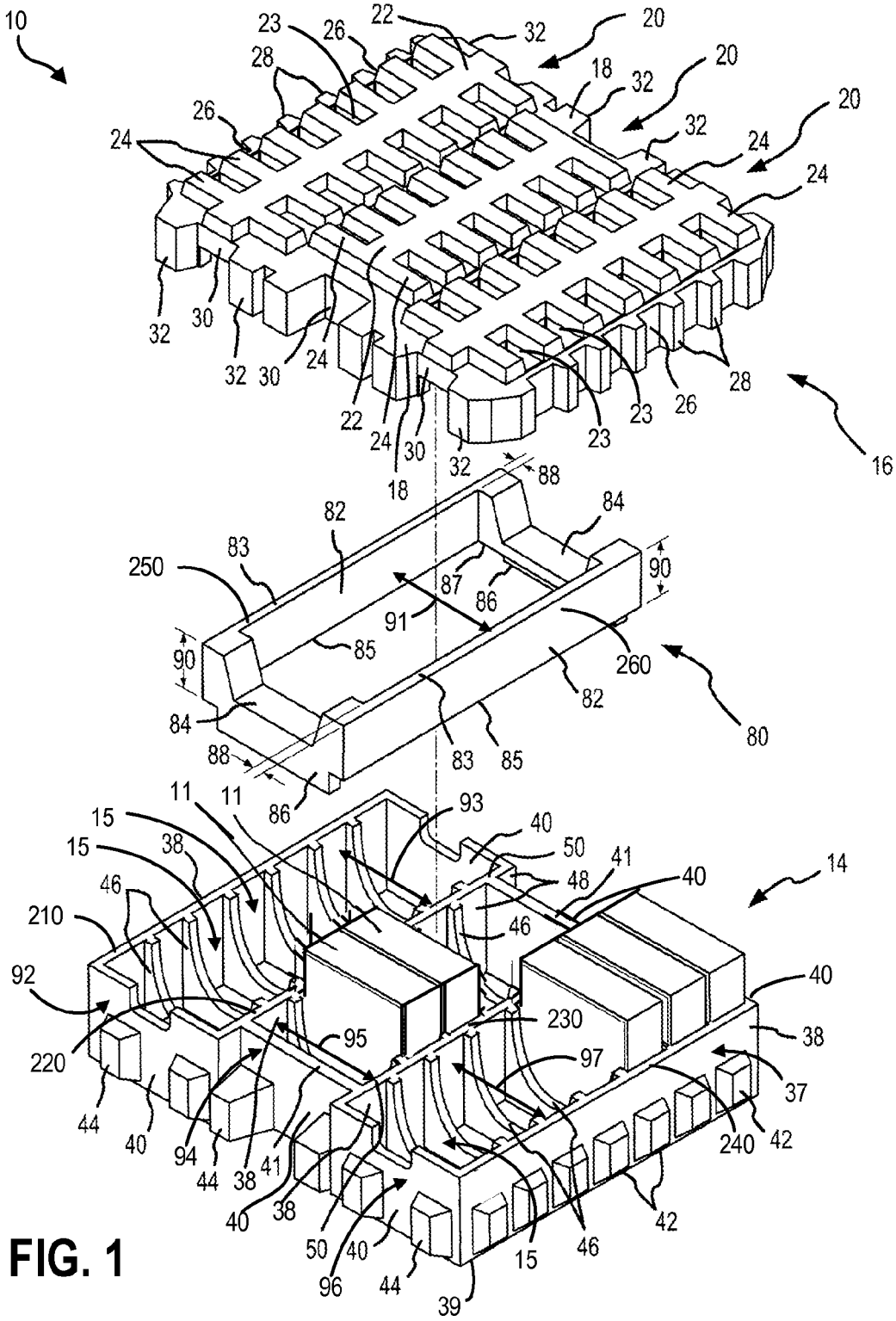
FIG. 1 is a partially exploded perspective view of a container.
Figure 2:
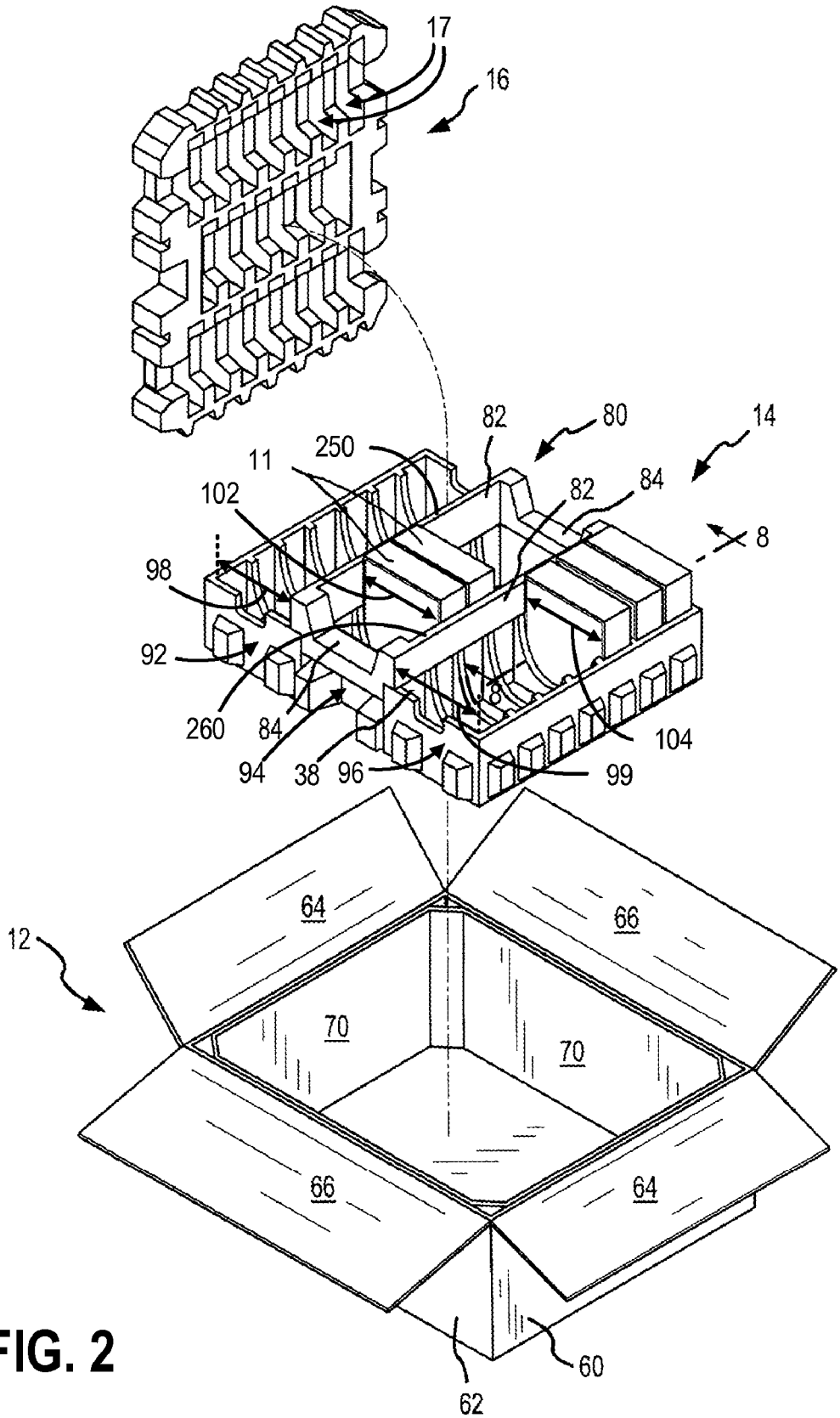
FIG. 2 is an exploded perspective view of the container of FIG. 1 including a carton.

FIG. 1 illustrates one embodiment of a container 10 for storing consumer electronics 11, while FIG. 2 illustrates the container 10 for storing consumer electronics 11 that are to be enclosed within a carton 12. Example consumer electronics 11 include digital music players, data storage systems, personal data assistants and cell phones. Container 10 includes a base 14, a cover 16, and an insert 80. Base 14 is configured to accommodate a plurality of consumer electronics 11. While consumer electronics 11 are one type of data storage system (i.e., disc drives) in one embodiment, it is noted that container 10 can be configured to store any type of data storage system or other type of consumer electronics. Further, in embodiments discussed below, insert 80 is adapted to be placed between base 14 and cover 16 to modify the size of compartments formed by the base and the cover.

In some embodiments, container 10 is placed in a carton 12 (illustrated in FIG. 2) having opposing end walls 60, opposing side walls 62, end flaps 64, and side flaps 66. In some embodiments, carton 12 is a corrugated or cardboard shell. Optionally, an insert 70 (for example, a corrugated insert) can be placed within the carton 12 to provide additional structural support to the carton 12. The cover 16 and base 14 of container 10 are sized such that they make a substantially flush contact with carton 12 after placement in the carton.

Base 14 includes a bottom 39, at least two end walls 40, and at least two side walls 38. Further, base 14 includes a plurality of base partitions 46 spaced from one another and arranged between the end walls 40 and the side walls 38. The base partitions 46 form a plurality of lower cavities 15 in base 14. Each lower cavity 15 is configured to receive a consumer electronics 11. In one embodiment, each lower cavity 15 has a width that extends between the side walls 38 of base 14.

In the embodiment illustrated in FIG. 1, base 14 includes four side walls 38 dividing the base 14 into three sets (i.e., sets 92, 94, and 96) of lower cavities 15 having respective widths 93, 95, and 97. In one embodiment, each set of lower cavities have similar widths (i.e., widths 93, 95, and 97 are substantially equal). In another embodiment, at least one set of lower cavities has a width that varies from the other sets of lower cavities (i.e., widths 93, 95, and 97 are not all equal). Further, while base 14 is illustrated as having three sets of lower cavities, base 14 can have any number of side walls 38 forming any number of sets of lower cavities 15. For example, in one embodiment, base 14 has more than three sets of lower cavities. In another embodiment, base 14 has two sets. In yet another embodiment, base 14 includes two side walls 38 that provide a single set of lower cavities 15.

Further, base 14 can have any number of end walls 40. In the embodiments illustrated in FIG. 1, base 14 has six end walls 40, each end wall being positioned at an end of a set of cavities. However, in other embodiments, base 14 can have more than, or less than, six end walls. For example, in one embodiment, base 14 has two end walls positioned on opposite ends of a set of lower cavities 15.

In one embodiment, a plurality of base partitions 46 divide each set (i.e., sets 92, 94, and 96) into a plurality of equally sized cavities 15. In some embodiments, base partitions 46 are spaced apart at varying distances. Thus, lower cavities 15 within a particular set can have either similar or different sizes. Further, in one embodiment lower cavities in a particular set (for example, sets 92, 94, or 96) are repeatedly positioned one adjacent to the next in a row. It is noted, however, that embodiments described herein are not limited to any particular configuration of the lower cavities of base 14.

Figure 6:
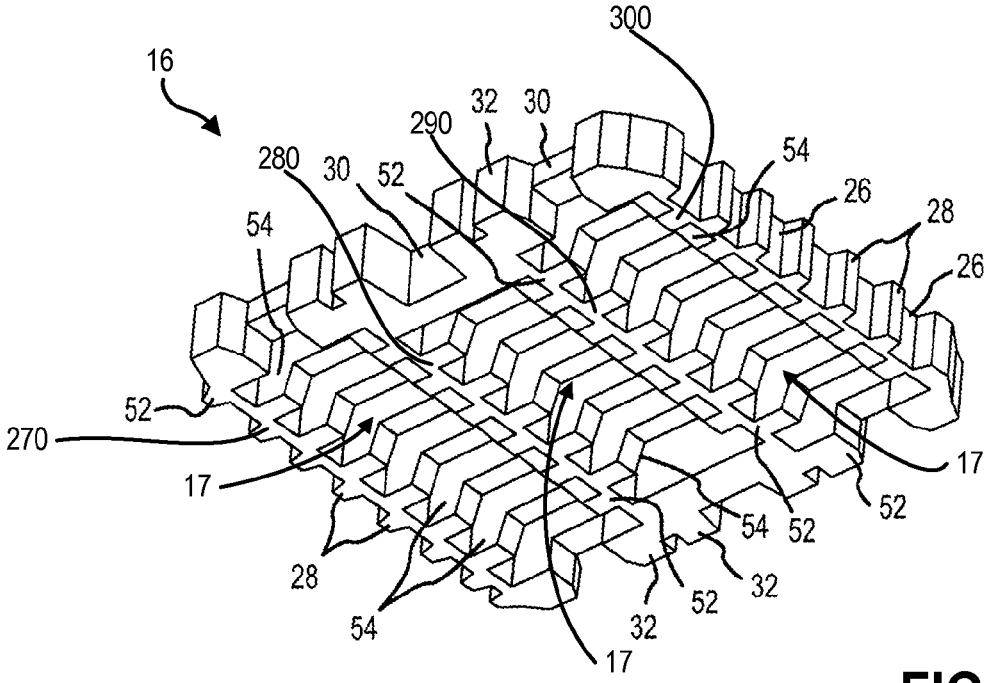
FIG. 6 is a perspective view of a lower surface of the cover of FIG. 5.

Cover 16 is configured to be placed over and positioned on side walls 38 of base 14. As illustrated in FIGS. 2 and 6, one embodiment of cover 16 includes a plurality of upper cavities 17 that correspond with lower cavities 15 of base 14. Thus, cavities 15 and 17 align to form a plurality of compartments for storing consumer electronics 11. In some embodiments, base 14 and cover 16 have a single set of lower and upper cavities, respectively, configured to form a container having a single set of compartments. In other embodiments, base 14 and cover 16 have two or more sets of lower and upper cavities, respectively, configured to form two or more sets of compartments. For example, the container can have 2, 3, 4, or 5 sets of compartments. In some embodiments, the container can have more than 5 sets of compartments. Further detailed embodiments of base 14 and cover 16 will be discussed below.

At least one insert 80 is configured to be placed on side wall 38 of base 14 and positioned between cover 16 and base 14 of container 10. Insert 80 modifies the size of each lower cavity 15 and each upper cavity 14 that form a compartment in container 10. In particular, the insert 80 extends into each lower cavity 15 and upper cavity 14 that form a compartment to make each compartment smaller. The insert 80 modifies the sizes of the compartments, while still providing adequate vibration and shock protection to prevent damage to consumer electronics during shipment and storage. The insert 80 also provides additional structural support to container 10, which provides increased shock protection for heavier consumer electronics.

As illustrated in FIG. 1, insert 80 includes at least one frame wall 82. Each frame wall 82 of insert 80 operates to supply pressure against each consumer electronics 11 stored within the compartments to securely support the consumer electronics within container 10. As illustrated in FIG. 1, insert 80 can include a pair of spaced apart frame walls 82 interconnected by a pair of webs 84 located at each end of the pair of frame walls 82. Accordingly, as illustrated, insert 80 has a generally rectangular configuration in one embodiment. Insert 80 is configured to be placed over and adjacent to at least a portion of a set of cavities 15 of base 14. In one embodiment, when insert 80 is positioned on base 14, lower surfaces 85 of the frame walls 82 adjoin upper edges 50 of side walls 38. Further, lower surfaces 87 of the webs 84 rest on the upper edges 41 of end walls 40 of the base 14. Further, in one embodiment, webs 84 each have a flange 86 that extends below the lower surfaces 87 of the respective web 84. Thus, when engaged with base 14, flanges 86 extend over and abut end walls 40 to discourage movement of the insert 80 in both longitudinal and transverse directions.

In some embodiments and as illustrated in FIGS. 1 and 2, only a single insert 80 is configured to be placed on inner side walls 38 of base 14 and over an interior set of cavities 15 of base 14. As illustrated in FIG. 1, one embodiment of base 14 includes a first side wall 210, a second side wall 220 spaced apart from the first side wall 210 by a first set of lower cavities 92, a third side wall 230 spaced apart from the second side wall 220 by a second set of lower cavities 94, and a fourth side wall 240 spaced apart from the third side wall 230 by a third set of lower cavities 96. In accordance with the illustrated embodiment, insert 80 is placed over the second set of lower cavities 94 such that a first frame wall 250 of the insert is positioned on the second side wall 220 and a second frame wall 260 is positioned on the third side wall 230. In other embodiments, insert 80 is configured to be placed over an exterior set of cavities 15 of base 14. For example, insert 80 can be placed over sets 92 or 96 and on first side wall 210 and second side wall 220 or third side wall 230 and fourth side wall 240. Further, in some embodiments, insert 80 includes more than two frame walls 82 and is configured to be placed over multiple sets of cavities 15. Further yet, in some embodiments, base 14 includes a single set of cavities 15 and insert 80 is configured to be placed over the one set of lower cavities.

In one embodiment, when insert 80 is positioned between the base 14 and cover 16, frame walls 82 are configured to extend into select compartments formed by the lower cavities 15 of base 14 and the upper cavities 17 of cover 16. In one embodiment, frame walls 82 have a width 88 that is at least slightly larger than the width of the respective side wall 38 on which the frame wall 82 is positioned. In the exemplary embodiment illustrated in FIGS. 1 and 2, insert 80 is configured to extend into and modify compartments in set 94 of base 14. In this embodiment, an interior width 91 between the frame walls 82 of insert 80 is less than a width 95 of the set of cavities 94 over which the insert is placed such that at least one frame wall 82 extends into the set 94. In one embodiment, width 91 is equal to or slightly greater than a length 102 (shown in FIG. 2) of the disc drives 11 placed in the set. Thus, for disc drives having smaller lengths 102, an insert having larger frame wall widths 88 (i.e., smaller width 91) can be utilized. On the other hand, for larger disc drives, smaller frame wall widths 88 (i.e., larger width 91) can be utilized.

Figure 3:
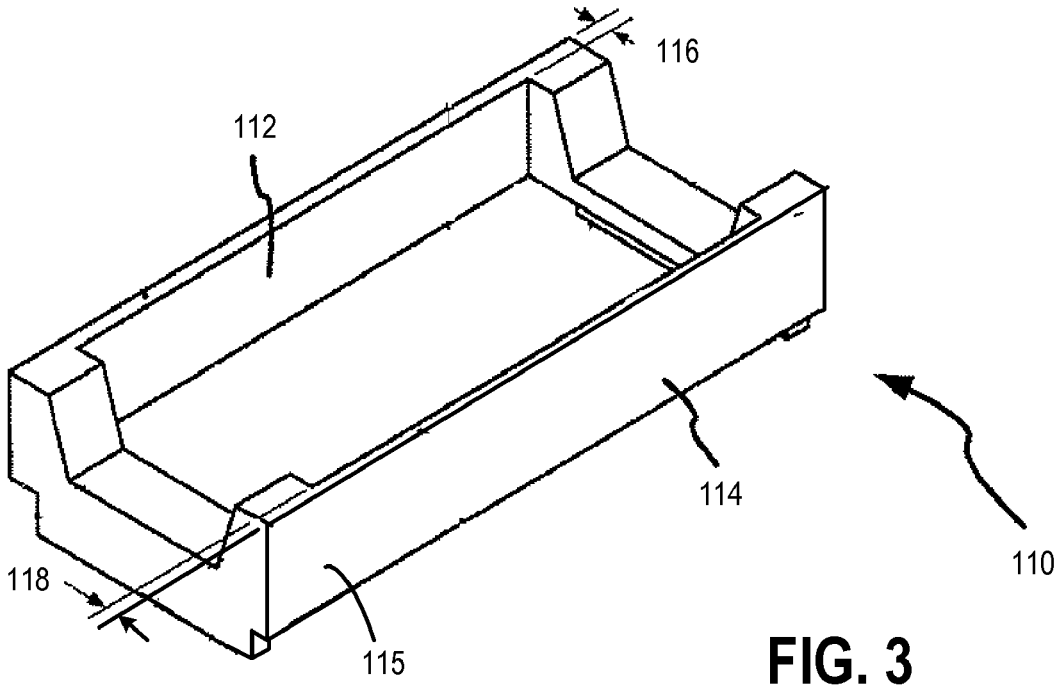
FIG. 3 is a perspective view of an insert.

In another embodiment, the frame walls 82 of insert 80 can be configured to extend into cavities that are adjacent a set of cavities over which the insert is positioned. For example, in the embodiment illustrated in FIG. 2, a first frame wall 250 can be configured to extend into compartments formed by the set of cavities 92. Further, a second frame wall 260 can be configured to extend into compartments formed by the set of cavities 96. As such, in one embodiment, the frame walls 82 of insert 80 also operate to modify a size of compartments formed by set 92 and/or set 96. To illustrate, reference numeral 98 (shown in FIG. 2) represents a modified width of compartments formed by the set of cavities 92. Width 98 is the distance from an exterior edge of the first frame wall 250 to an interior edge of cavities in set 92. Similarly, width 99 is the distance from an exterior edge of the second frame wall 260 to an interior edge of cavities in set 96. In one embodiment, at least one of widths 98 and 99 is less than widths 93 and 97 of set of cavities 92 and 96, respectively. Further, in one embodiment, widths 98 and 99 are equal to or slightly greater than the length of consumer electronics 11 placed in compartments formed by set of cavities 92 and 96. Further, while widths 88 of frame walls 82 are illustrated in FIG. 1 as being substantially similar, some embodiments of the insert include frame walls having widths that differ from one another. For example, FIG. 3 illustrates one embodiment of an insert 110 including frame walls 112 and 114 having respective widths 116 and 118. As illustrated, width 116 can be similar to width 88 described in FIG. 1. For example, frame wall 112 can be configured to extend into a pair of adjacent sets of compartments (such as sets 92 or 94 in FIG. 1). On the other hand, frame wall 114 has a width 118 that is less than width 116. In one embodiment, frame wall 114 is configured to extend into a pair of adjacent compartments (such as sets 94 or 96 in FIG. 1). In another embodiment, frame wall 114 only extends into one set of compartments. For example, support 114 can be configured to only extend into compartments that are between frame walls 112 and 114. Further, in one embodiment frame wall 114 is configured such that when insert 110 is positioned over an exterior set of compartments (for example, sets 92 or 96), an exterior surface 115 of frame wall 114 is substantially flush with an exterior surface of side wall 38 of the base 14.

Figure 4:
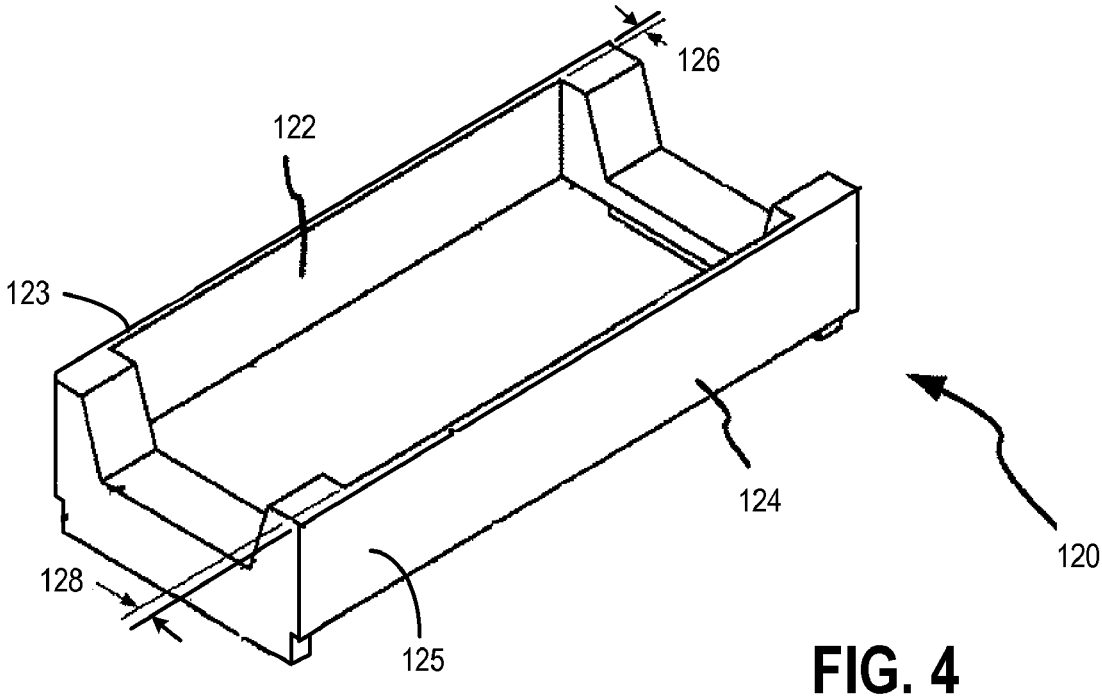
FIG. 4 is a perspective view of an insert.

Further, in some embodiments, the insert is configured to extend into and modify the size of only one set of compartments. For example, FIG. 4 illustrates an insert 120 including frame walls 122 and 124 having respective widths 126 and 128. In one embodiment, widths 126 and 128 are configured such that the frame walls 122 and 124 only extend into set(s) of compartments that are between frame walls 122 and 124. For example, insert 120 can be utilized with base 14 of FIGS. 1 and 2. In one embodiment, insert 120 is placed over an interior set 94 such that frame walls 122 and 124 extend into set 94, but not into adjacent sets 92 or 96. In one embodiment, insert 120 is utilized with a base having a single set of lower cavities. In another embodiment, exterior edges 123 and 125 of the respective frame walls are configured such that they are flush with exterior surfaces (for example, edge 37 illustrated in FIG. 1) of end walls of the base.

Figure 5:
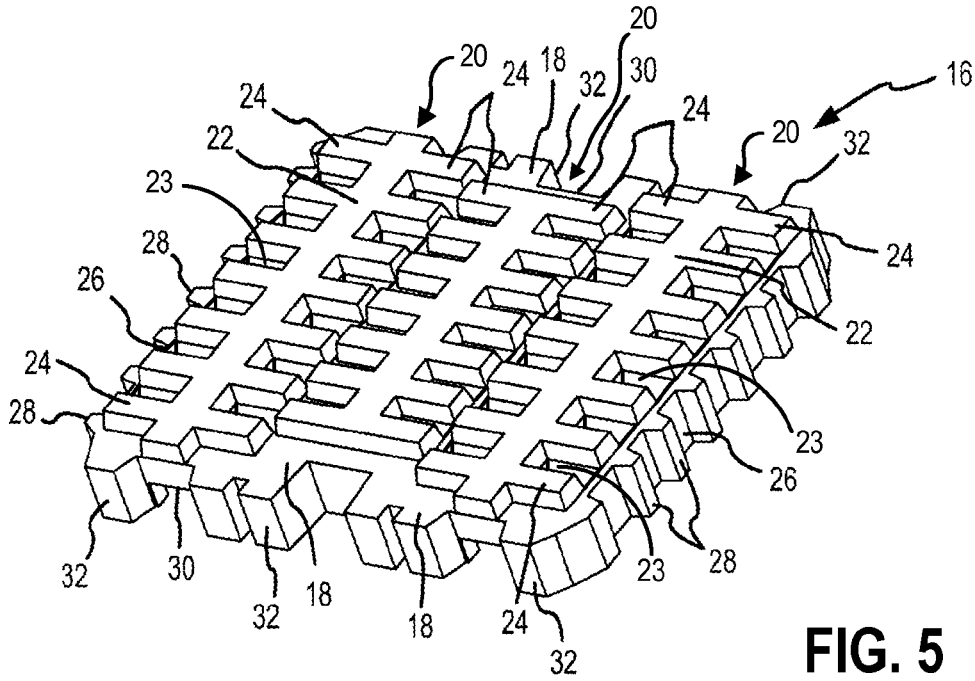
FIG. 5 is a perspective view of an upper surface of the cover of a container.

FIGS. 5 and 6 illustrate top and bottom perspective views, respectively, of embodiments of cover 16. As illustrated in FIGS. 1 and 5, one embodiment of cover 16 includes a planar top surface 18 and a plurality of cushioning rib sets 20 on the top surface 18. In one embodiment, each set of cushioning ribs 20 includes a plurality of individual cushioning ribs 24 arranged in opposing pairs. As illustrated, top surface 18 of the cover 16 extends in a gap 23 between each pair of adjacent ribs 24. As illustrated, in some embodiments, each gap 23 includes a recess that is recessed into top surface 18.

In one embodiment, a central support beam 22 interconnects pairs of cushioning ribs 24, and the beam 22 extends substantially perpendicular to the pairs of cushioning ribs 24. Cover 16 can includes three sets 20 of cushioning ribs 24 disposed in parallel with respect to one another. However, in some embodiments, cover 16 includes more than or less than three cushioning rib sets 20. Further, in some embodiments, cover 16 includes a plurality of end cushioning ribs or pads 28 that extend outward from respective end surfaces 26 and a plurality of side cushioning ribs or pads 32 that extend outward from respective side surfaces 30. While embodiments of cover 16 are described as including cushioning ribs, some embodiments of cover 16 do not include cushioning ribs.

Referring to FIG. 6, in one embodiment, a bottom surface 52 of cover 16 is planar and extends peripherally around the cover 16. Further, the bottom surface 52 extends between the sets of cover partitions 54. Cover partitions 54 define a plurality of upper cavities 17 that receive upper ends of consumer electronics positioned in respective lower cavities 15 (FIG. 1) of the base 14. Cover 16 includes four side walls 270, 280, 290, 300 dividing the cover into three sets of upper cavities 17, which align respectively with side walls 210, 220, 230, 240 of base dividing the lower cavities 15 into three sets. As mentioned above, the upper cavities 17 are configured to align with the lower cavities 15 to form compartments when the cover is positioned over and on top of side walls 38 of the base. Thus, any configuration of the cover is within the scope of the concepts described herein. In some embodiments, the cover 16 has a single set of cavities. In other embodiments, the cover includes a plurality of upper cavity sets. For example, in some embodiments, cover 16 comprises three sets of upper cavities 17 that align with corresponding three sets of lower cavities 15 of base 14.

Further, in one embodiment, the cover partitions 54 are arranged such that pairs of cushioning rib 24 (FIGS. 1 and 5) on top surface 18 of cover 16 are disposed directly above corresponding compartments 17. In one embodiment, the cover partitions 54 have a trapezoidal shaped cut out; however, it shall be understood that the cover partitions 54 can have any suitable shape such as a rectangular shape with a lower surface coplanar with lower surface 52.

In one embodiment, when the cover 16 is positioned over the base 14, the upper surfaces 50 of the side walls 38 (FIG. 1) of base 14 align with the portions of the bottom surface 52 of cover 16 that extends between the sets 20 of cushioning ribs. Accordingly, each upper cavity of cover 16 aligns with a corresponding lower cavity of the 14. In this embodiment, side wall 210 of base 14 aligns with side wall 270 of cover 16; side wall 220 of base 14 aligns with frame wall 250 of insert 80 and side wall 280 of cover 16; side wall 230 of base 14 aligns with frame wall 260 of insert 80 and side wall 290 of cover 16; side wall 240 of base 14 aligns with side wall 300 of cover 16. Further, in one embodiment, when cover 16 is placed over base 14, the upper edges 83 of the frame walls 82 of the insert 80 make substantially flush contact with the portions of the bottom surface 52 of the cover 16. A depth 90 of the frame walls 82 of insert 80 can be adjusted (i.e., increased or decreased) according to the desired level of contact (i.e., support) between the insert and the consumer electronics positioned in the compartments.

Figure 7:
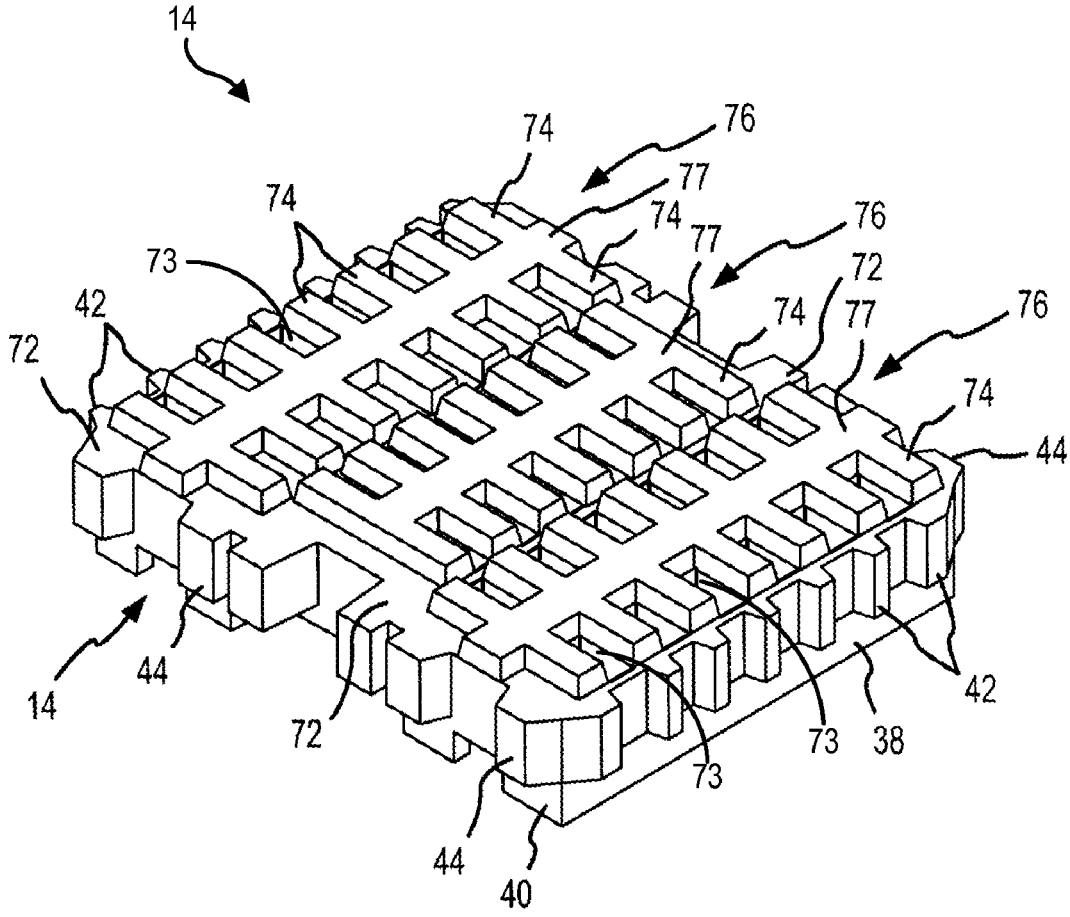
FIG. 7 is a perspective view of a lower surface of a base of a container.

FIG. 7 is a perspective view of the base 14. In one embodiment, a bottom planar surface 72 of the base 14 incorporates the same or similar cushioning rib configuration as the top surface 18 of the cover 16. More specifically, the bottom surface 72 can also be characterized by a plurality of pairs of cushioning ribs 74 arranged in three sets 76, each pair of cushioning ribs 74 being interconnected by a central support beam 77 that extends substantially perpendicular to the pairs of ribs 74. Bottom surface 72 extends into a gap 73 between adjacent ribs 74, in one embodiment. In some embodiments, gaps 73 include a recess that is recessed into bottom surface 72.

In one embodiment, each pair of cushioning ribs 74 is disposed directly below a corresponding lower cavity 15 of the base 14. Further, with reference to FIGS. 1 and 2, some embodiments of the base include a plurality of end cushioning ribs/pads 42 extending from side walls 38 and a plurality of side cushioning ribs/pads 44 extending outward from end walls 40. It is noted that while embodiments of the base 14 have been described as including cushion ribs, some embodiments of base 14 do not include cushioning ribs. Any suitable configuration of base 14 is within the scope of the concepts presented herein.

It is pointed out that the exterior surfaces of each of the cushioning ribs 24, 28, 32, 42, 44, and 74 of base 14 and cover 16 can make contact with the interior surfaces of the carton 12 (or with insert 70, if used) illustrated in FIG. 2. Further, each of the cushioning ribs or pads 24, 28, and 32 can have a substantially flat exterior surface enabling each rib/pad to make flush contact with interior surfaces of the carton 12.

Figure 8:
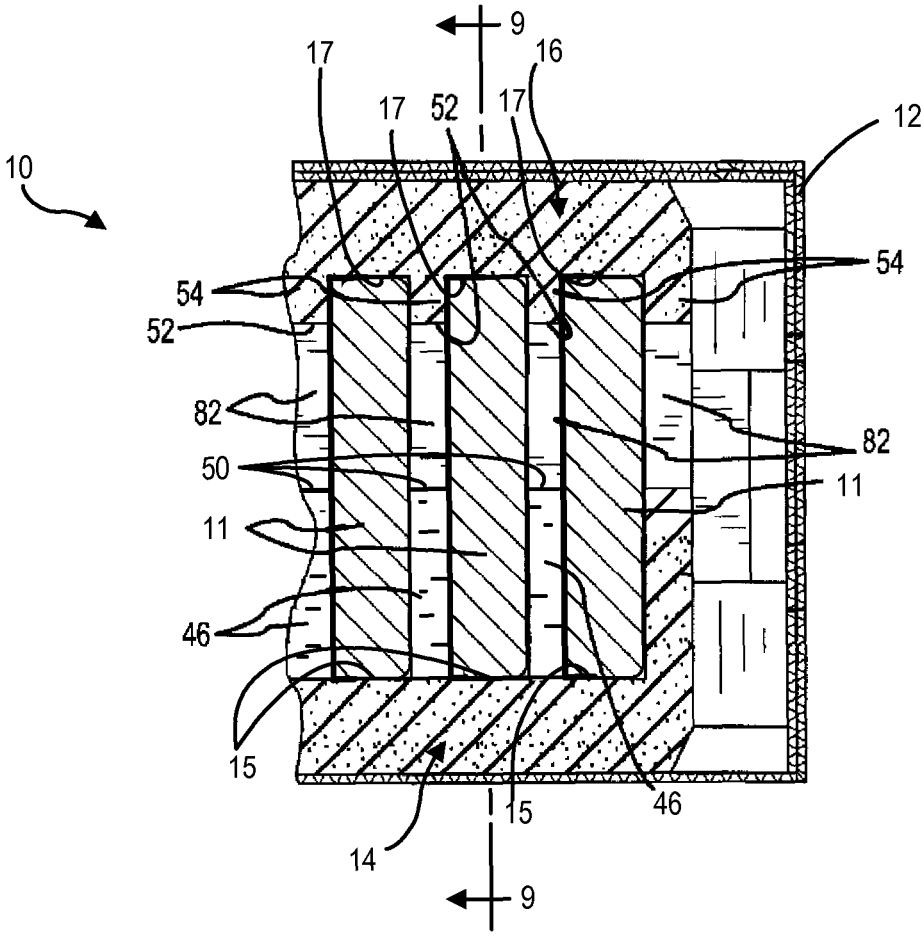
FIG. 8 is a sectional view across section plane 8-8 of the container illustrated in FIG. 2.

FIG. 8 is a sectional view (across section plane 8-8 of the container illustrated in FIG. 2) of one embodiment of container 10 having cover 16 engaged to base 14. Further, container 10 is illustrated within a carton 12, such as the carton illustrated in FIG. 2. In FIG. 8, a section of the container 10 is illustrated as being loaded with three consumer electronics 11 separated by base partitions 46 and cover partitions 54.

In one embodiment, the container is configured to securely support consumer electronics stored therein. In one example, the base 14, cover 16, and insert 80 apply a prescribed amount of pressure against the consumer electronics to discourage the consumer electronics from moving within the container during shipment or storage. In one embodiment, the consumer electronics are shipped within sealed flexible bags. In this embodiment, the upper and lower cavities are sized to provide compartments to accommodate and secure the consumer electronics 11 within the compartments while taking into account the sealed bag, if used.

Figure 9:
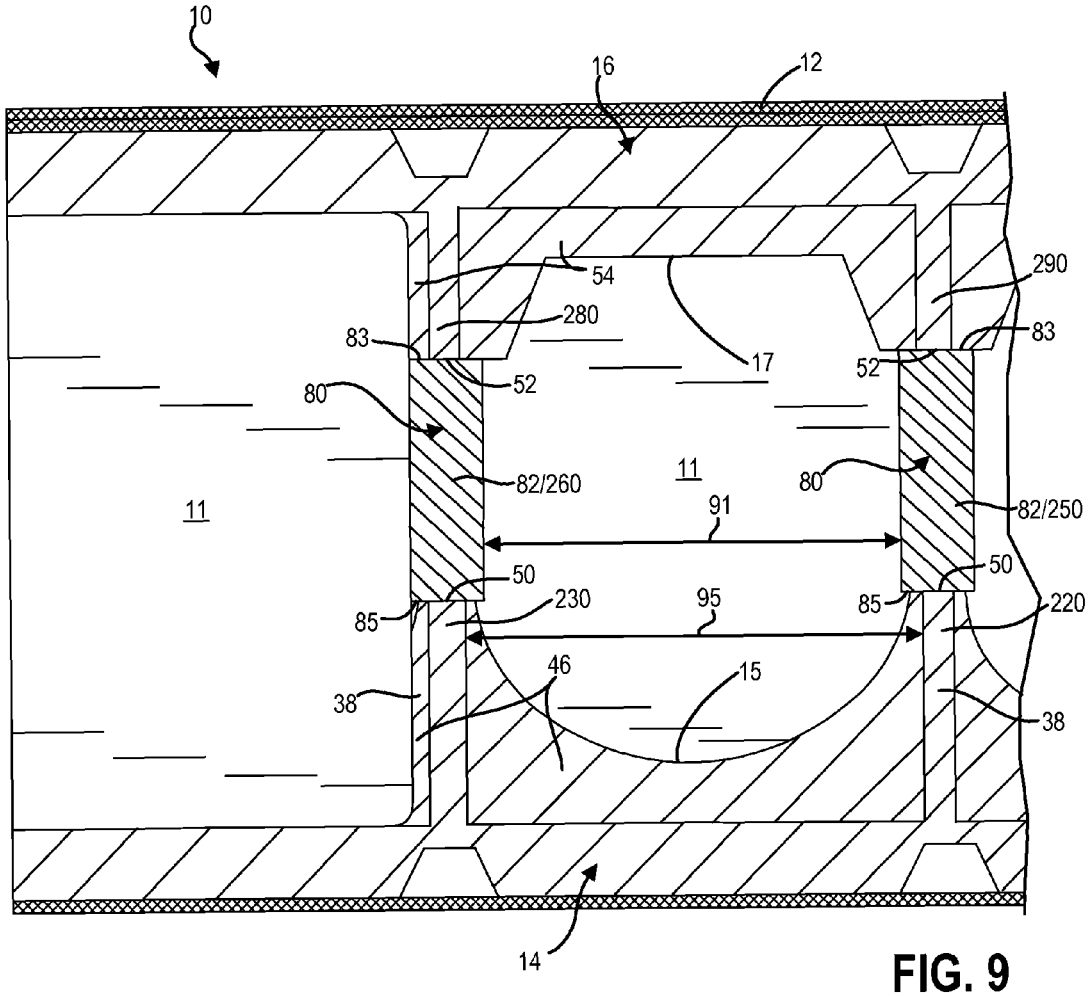
FIG. 9 is a sectional view across section plane 9-9 of the container illustrated in FIG. 8.

FIG. 9 is a sectional view (across section plane 9-9 of the container illustrated in FIG. 8) of the embodiment of container 10 having cover 16 engaged to base 14 as illustrated in FIG. 8. Further, as discussed above, container 10 is illustrated within a carton 12, such as the carton illustrated in FIG. 2. FIG. 9 illustrates consumer electronics 11 supported by base partitions 230 and cover partitions 290. Frame walls 260 of insert 80 bridges the upper edges 50 of third side wall 230 of base 14 to lower surface 52 of third side wall 290 of cover 16.

It is to be understood that even though numerous characteristics and advantages of various embodiments of the disclosure have been set forth in the foregoing description, this disclosure is illustrative only, and changes may be made in detail, especially in matters of structure and arrangement of parts within the principles of the disclosure to the full extent indicated by the broad general meaning of the terms in which the appended claims are expressed. For example, the particular elements may vary depending on the particular application for the consumer electronics while maintaining substantially the same functionality without departing from the scope and spirit of the present invention. In addition, although the preferred embodiment described herein is directed to an acoustic damping and shock cushioning for a disc drive, it will be appreciated by those skilled in the art that the teachings of the present invention can be applied to other types of consumer electronics, without departing from the scope and spirit of the present invention.

What is claimed is:

1. A container for shipping and storing consumer electronics, comprising:

a base having an interior side including two end walls and at least four side walls each having a base side wall width, the base including base partitions forming a plurality of lower cavities for receiving the consumer electronics, the base partitions being spaced from one another and arranged between the end walls and the side walls, each lower cavity having a width extending between two of the side walls;

a cover having an interior side including at least four sidewalls each having a cover side wall width that align with the four side walls of the base, the interior side of the cover having a plurality of cover partitions forming a plurality of upper cavities adapted to align with the lower cavities of the base to form compartments there between that are configured to store the consumer electronics, each upper cavity having a width extending between two of the sidewalls; and an insert positioned between the base and the cover, the insert including a first frame wall and a second frame wall each having a frame wall width and a pair of webs located at ends of the first and second frame walls for connecting the first and second frame walls together, the frame wall width being greater than the base side wall width and the cover side wall width such that the first and second frame walls abut an upper edge of the two side walls of the base and abut a bottom surface of the two side walls of the cover yet extend into the compartments of the container.

2. The container of claim 1 wherein the first side wall is spaced apart from the second side wall of the base by a first distance and the first frame wall is spaced apart from the second frame wall of the insert by a second distance, the second distance being less than the first distance.

3. The container of claim 1 wherein a second side wall of the base is spaced apart from a first side wall of the base by a first set of lower cavities and a third side wall of the base is spaced apart from the second side wall by a second set of lower cavities, wherein the insert extends into a first and second set of compartments formed by the first and second set of lower cavities, respectively.

4. The container of claim 1 wherein a second side wall of the base is spaced apart from a first side wall by a first set of lower cavities; a third side wall of the base is spaced apart from the second side wall by a second set of lower cavities; and a fourth side wall of the base is spaced apart from the first side wall by a third set of lower cavities, wherein the insert extends into the first, second and third set of compartments formed by the first, second, and third sets of lower cavities.

5. The container of claim 4 wherein the first, second, and third sets of lower cavities have widths that are substantially equal.

6. The container of claim 4 wherein the first frame wall and the second frame wall of the insert are separated by a distance that is less than a width of the each of the lower cavities.

7. The container of claim 6 wherein the first frame wall of the insert extends into the first and third set of compartments formed by the first and third set of lower cavities and the second frame wall extends into first and second compartments formed by the first and second set of lower cavities.

8. The container of claim 1 wherein each web of the insert includes a flange that extends below the lower surfaces of the frame walls of the insert.

9. The container of claim 1, wherein the exterior of the cover and the exterior of the base include a plurality of cushioning ribs.

10. The container of claim 1 wherein the container is enclosed within a carton.

11. A container for storing data storage systems, comprising:

a base having an exterior side and an interior side the interior side including two end walls, at least four side walls each having a base side wall width and upper edges that extend between the end walls, and a plurality of base partitions forming a plurality of lower cavities for receiving data storage systems, the base partitions being spaced from one another and arranged between the end walls and each side wall, each lower cavity having a width extending between each side wall, the at least four side walls comprising:

a first side wall;

a second side wall spaced apart from the first side wall by a first set of lower cavities;

a third side wall spaced apart from the second side wall by a second set of lower cavities;

a fourth side wall spaced apart from the third side wall by a third set of lower cavities;

a cover having an exterior side and an interior side, the interior side including at least four sidewalls each having a cover side wall width that align with the four side walls of the base and a plurality of cover partitions forming a plurality of upper cavities adapted to align with the lower cavities of the base to form first, second, third and fourth sets of compartments there between, the compartments configured to store the data storage systems, each upper cavity having a width extending between two of the sidewalls; and an insert positioned between the base and the cover, the insert including a first frame wall and a second frame wall having lower surfaces and upper edges and each having a frame wall width and a pair of webs located at ends of the first and second frame walls for connecting the first and second frame walls together, the frame wall width being greater than the base side wall width and the cover side wall width such that the lower surfaces of each frame wall abut upper edges of two of the at least four side walls of the base and the upper edges of each frame wall abut bottom surfaces of two of the at least four side walls of the cover yet extend into each compartment of the container.

12. The container of claim 11 wherein the first frame wall of the insert abuts the upper edge of the second side wall of the base and the second frame wall of the insert abuts the upper edge of the third side wall of the base, the first and second frame walls of the insert being spaced apart a distance that is less than a width of the second set of lower cavities of the base.

13. The container of claim 12 wherein the first frame wall of the insert extends into the first and second set of compartments and the second frame wall of the insert extends into the third and fourth set of compartments.

14. The container of claim 12 wherein each web is positioned on the upper edges of the two end walls of the base, wherein each web of the insert includes a flange that extends below the lower surfaces of the frame walls of the insert.

15. The container of claim 12 wherein at least one external surface of the base and cover includes a plurality of cushioning ribs.

16. A container for storing consumer electronics, comprising:

a base having an interior side including two end walls and at least two side walls each having a base side wall width and including upper edges, the base including base partitions forming a plurality of lower cavities for receiving the consumer electronics, the base partitions being spaced from one another and arranged between the end walls and the side walls, each lower cavity having a width extending between two of the side walls;

a cover having an interior surface including at least two side walls each having a cover side wall width and including bottom surfaces, the cover including a plurality of cover partitions forming a plurality of upper cavities adapted to align with the lower cavities of the base to form a plurality of compartments there between, the compartments configured to store the consumer electronics; and means for modifying a size of compartments of the plurality of compartments, wherein the means includes a first frame wall and a second frame wall each having a frame wall width and a pair of webs located at ends of the first and second frame walls for connecting the first and second frame walls together and positioned between the base and cover, the frame wall width being greater than the base side wall width and the cover side wall width such that the first and second frame walls abut the upper edges of two side walls of the base and abut the bottom surfaces of the two side walls of the cover yet extend into the compartments of the container.

17. The container of claim 16 wherein the means for modifying compartments includes an insert comprising the first frame wall and the second frame wall configured to extend into the compartments.

18. The container of claim 16 wherein the at least two side walls of the base comprise:

a first side wall;

a second side wall spaced apart from the first side wall by a first set of lower cavities;

a third side wall spaced apart from the second side wall by a second set of lower cavities; and a fourth side wall spaced apart from the third side wall by a third set of lower cavities.

19. The container of claim 18 wherein the first and second frame walls are configured to extend into the first, second and third set of lower cavities.

20. The container of claim 19 wherein the first frame wall extends into the first and second set of lower cavities and the second frame wall extends into the second and third set of lower cavities.

* * * * *